US009475305B2

(12) United States Patent
Ito et al.

(10) Patent No.: US 9,475,305 B2
(45) Date of Patent: Oct. 25, 2016

(54) LIQUID SUPPLY APPARATUS AND LIQUID EJECTION APPARATUS WITH CONTACTLESS DETECTION OF LIQUID REMAINING AMOUNT

(71) Applicant: CANON FINETECH INC., Misato-shi, Saitama (JP)

(72) Inventors: Hideyuki Ito, Tsukubamirai (JP); Marie Ogata, Koshigaya (JP); Masato Kawakami, Misato (JP); Yoshihito Fukuda, Misato (JP)

(73) Assignee: CANON FINETECH INC., Misato-Shi, Saitama (JP)

( * ) Notice: Subject to any disclaimer, the term of this patent is extended or adjusted under 35 U.S.C. 154(b) by 0 days.

(21) Appl. No.: 14/667,447

(22) Filed: Mar. 24, 2015

(65) Prior Publication Data

US 2015/0273854 A1 Oct. 1, 2015

(30) Foreign Application Priority Data

Mar. 26, 2014 (JP) ..... 2014-064372

(51) Int. Cl.
*B41J 2/19* (2006.01)
*B41J 2/175* (2006.01)

(52) U.S. Cl.
CPC .. *B41J 2/19* (2013.01); *B41J 2/175* (2013.01)

(58) Field of Classification Search
CPC ..... B41J 2/19; B41J 2/175
See application file for complete search history.

(56) References Cited

U.S. PATENT DOCUMENTS

| | | | | |
|---|---|---|---|---|
| 5,179,389 | A | 1/1993 | Arai et al. | 346/1.1 |
| 6,315,402 | B1 * | 11/2001 | Kawase | B41J 2/17513 347/85 |
| 8,042,902 | B2 | 10/2011 | Katada | 347/17 |
| 8,128,212 | B2 * | 3/2012 | Katada | B41J 2/175 347/89 |
| 8,235,482 | B2 * | 8/2012 | Katada | B41J 2/17556 347/19 |
| 2008/0198207 | A1 * | 8/2008 | Katada | B41J 2/175 347/85 |
| 2012/0026256 | A1 * | 2/2012 | Shibata | B41J 2/17596 347/85 |
| 2012/0140006 | A1 | 6/2012 | Yunoki et al. | B41J 2/17 |
| 2013/0286116 | A1 * | 10/2013 | Takahashi | B41J 2/18 347/92 |

FOREIGN PATENT DOCUMENTS

| | | |
|---|---|---|
| EP | 2018970(A) | 1/2009 |
| EP | 2110248(A) | 10/2009 |

(Continued)

OTHER PUBLICATIONS

Computer-generated machine translation of Japan 2009-234151.

(Continued)

*Primary Examiner* — Bradley Thies
(74) *Attorney, Agent, or Firm* — Fitzpatrick, Cella, Harper and Scinto

(57) ABSTRACT

A liquid supply apparatus includes a supply passage for supplying a liquid stored in a liquid storage section to a liquid ejection head. The liquid supply apparatus further includes: a region set within a range including an inside of the liquid storage section and an inside of the supply passage, pressure applied to the liquid in the region varying according to an amount of the liquid remaining in the liquid storage section or in the supply passage; a gas chamber communicating with the region in such a manner that a pressure of gas in the gas chamber varies according to the pressure applied to the liquid in the region; and a pressure sensor detecting pressure in the gas chamber.

15 Claims, 8 Drawing Sheets

(56) References Cited

FOREIGN PATENT DOCUMENTS

| | | |
|---|---|---|
| EP | 2281688(A) | 2/2011 |
| JP | 2009-234151 | 10/2009 |
| JP | 2012-011643(A) | 1/2012 |
| WO | 2012/137523 | 10/2012 |

OTHER PUBLICATIONS

Computer-generated machine translation of WO 2012/137523.
Extended European Search Report, dated Jul. 22, 2016, in counterpart European Patent Application No. 15160827.0.

* cited by examiner

LIQUID SUPPLY APPARATUS AND LIQUID EJECTION APPARATUS WITH CONTACTLESS DETECTION OF LIQUID REMAINING AMOUNT

BACKGROUND OF THE INVENTION

1. Field of the Invention

The present invention relates to a liquid supply apparatus for supplying a liquid such as ink, and a liquid ejection apparatus for ejecting a liquid such as ink.

2. Description of the Related Art

Liquid ejection apparatuses include, for example, an inkjet printing apparatus that ejects ink as liquid from a print head as a liquid ejection head to print an image. In such a printing apparatus, the ink is supplied to the print head from an ink tank (liquid storage section) installed independently of the print head, and when the amount of ink remaining in the ink tank has become zero, the ink tank is replaced with a new one.

U.S. Pat. No. 5,179,389 discloses the structure of using a pressure sensor in contact with ink to detect pressure applied to the ink in such an ink tank for detection of the amount of ink remaining in the ink tank.

SUMMARY OF THE INVENTION

The present invention provides a liquid supply apparatus and a liquid ejection apparatus that are capable of readily detecting the amount of a liquid remaining in a liquid storage section without contact with the liquid.

In the first aspect of the present invention, there is provided a liquid supply apparatus including a supply passage for supplying a liquid stored in a liquid storage section to a liquid ejection head, comprising: a region set within a range including an inside of the liquid storage section and an inside of the supply passage, pressure applied to the liquid in the region varying according to an amount of the liquid remaining in the liquid storage section or in the supply passage; a gas chamber communicating with the region in such a manner that a pressure of gas in the gas chamber varies according to the pressure applied to the liquid in the region; and a pressure sensor detecting a pressure in the gas chamber.

In the second aspect of the present invention, there is provided a liquid ejection apparatus comprising a liquid ejection head and a liquid supply apparatus including a supply passage for supplying liquid to the liquid ejection head, wherein the liquid supply apparatus comprises: a liquid storage section; a region set within a range including an inside of the liquid storage section and an inside of the supply passage, pressure applied to the liquid in the region varying according to an amount of the liquid remaining in the liquid storage section or in the supply passage; a gas chamber communicating with the region in such a manner that a pressure of gas in the gas chamber varies according to the pressure applied to the liquid in the region; a pressure sensor detecting pressure in the gas chamber; and a determination unit configured to determine the amount of the liquid in the liquid storage section based on a detection result by the pressure sensor.

In the third aspect of the present invention, there is provided an inkjet printing apparatus comprising an inkjet print head and an ink supply apparatus including a supply passage for supplying ink to the inkjet print head, wherein the ink supply apparatus comprises: an ink reservoir section; a region set within a range including an inside of the ink reservoir section and an inside of the supply passage, pressure applied to the ink in the region varying according to an amount of the ink remaining in the ink reservoir section or in the supply passage; a gas chamber communicating with the region in such a manner that a pressure of gas in the gas chamber varies according to the pressure applied to the ink in the region; a pressure sensor detecting pressure in the gas chamber; and a determination unit configured to determine the amount of the ink in the ink reservoir section based on a detection result by the pressure sensor.

Further features of the present invention will become apparent from the following description of exemplary embodiments (with reference to the attached drawings).

DESCRIPTION OF THE EMBODIMENTS

Embodiments according to the present invention will be described below with reference to the accompanying drawings. The following embodiments are examples of applications to an inkjet printing apparatus that prints an image by ejecting ink, which is a liquid, from an inkjet print head serving as a liquid ejection head.

First Embodiment

Figure 1:
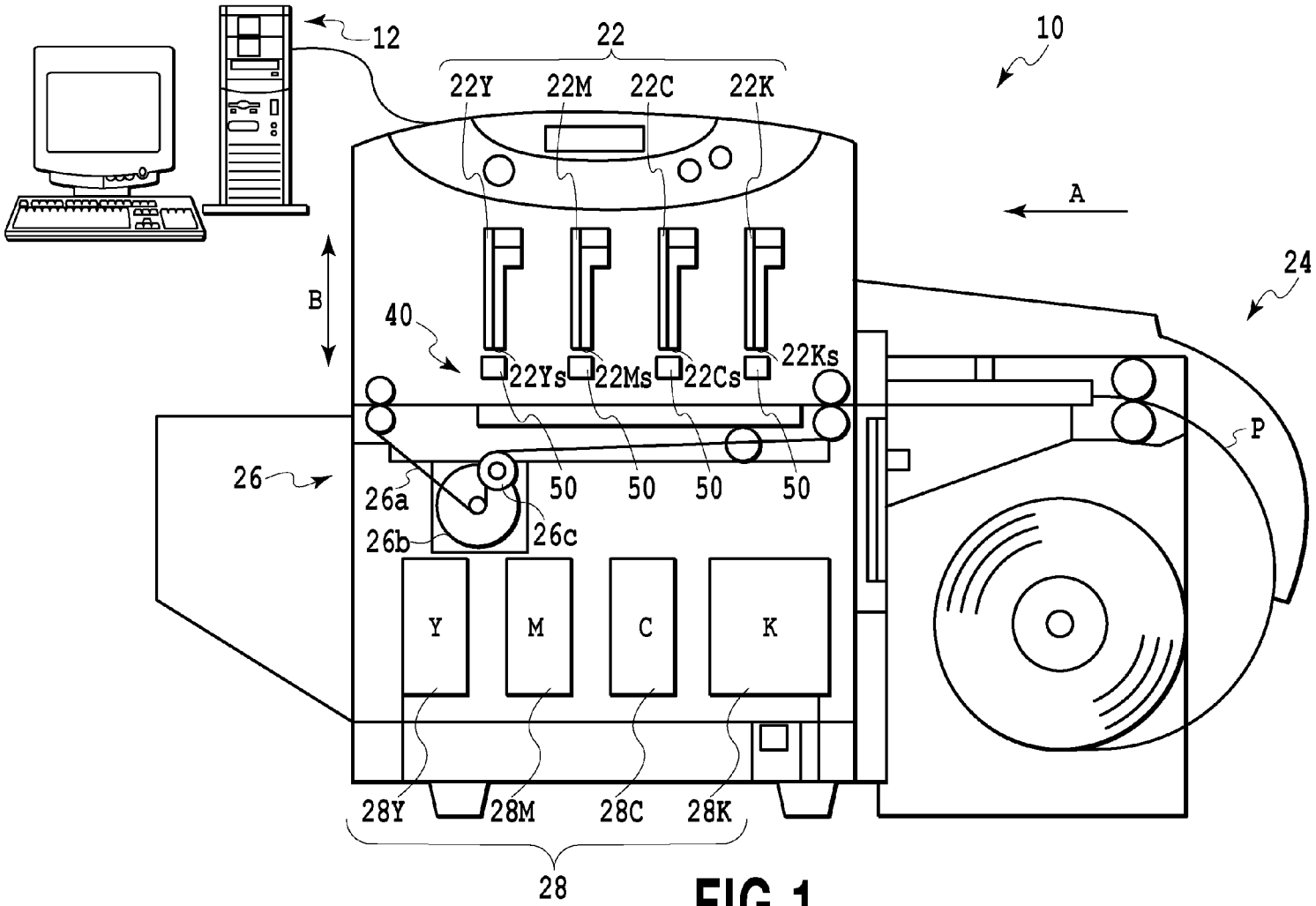
FIG. 1 is a schematic structure of a printing apparatus according to a first embodiment of the present invention.

FIG. 1 is a front view schematically illustrating a full-line type inkjet printing apparatus 10 in the present embodiment.

The printing apparatus 10 is connected to a host apparatus (personal computer) 12 that sends image information (including print data and commands) to the printing apparatus 10. The printing apparatus 10 includes a plurality of print heads (liquid ejection heads) 22 (four print heads 22K, 22C, 22M, 22Y in the present embodiment) arranged side-by-side in a conveying direction (the direction of arrow A) of a print medium (roll paper in the present embodiment) P. The print heads 22K, 22C, 22M, 22Y respectively eject black, cyan, magenta and yellow inks. The print heads 22 are so-called line heads.

Each of the print heads 22 has a plurality of nozzles capable of ejecting ink. The nozzles are arranged to form a nozzle row extending in a direction crossing the conveying direction of arrow A (at right angles in the present embodiment). The length of the nozzle row is longer than the maximum width of the roll paper P printable by the printing apparatus 10. The nozzle is structured to eject ink by use of an ejection energy generation element such as an electrothermal transducing element (heater), a piezo element or the like. In the case of using the electrothermal transducing element, it generates heat to cause the ink to create bubbles. This bubble energy is used to eject the ink from an ejection port of the distal end of the nozzle.

Each of the print heads 22 (22K, 22C, 22M, 22Y) is equipped with a recovery unit 50 to perform a recovery process to maintain ink ejection performance. The recovery unit 50 includes a cap for protection of the nozzles in the print head 22. The cap is also used for a preliminary ejection of ejecting ink that does not contribute to image printing from the ejection port, for suction discharge of ink from the ejection port (suction recovery process), and for pressurization discharge of ink from the ejection port (pressurization recovery process), as described later. The recovery unit 50 includes a wiper member provided for removing the ink adhering to the formation surface of the ejection port in the print head 22 (wiping process). The printing apparatus 10 includes ink tanks 28 (28K, 28C, 28M, 28Y) for storing ink to be supplied to the print heads 22 (22K, 22C, 22M. 22Y), and an ink supply system which will be described later.

The roll paper P is supplied from a roll-paper supply unit 24 to be conveyed in the conveying direction of arrow A by a conveying mechanism 26 incorporated in the printing apparatus 10. The conveying mechanism 26 includes a conveying belt 26*a* carrying the print medium P thereon, a conveying motor 26*b* rotating the conveying belt 26*a*, and a roller 26*c* for application of tension to the conveying belt 26*a*.

The printing apparatus 10 in the present embodiment is of a so-called full-line type and therefore is capable of printing an image on the roll paper P by ejecting ink from the print heads 22 in a fixed position while continuously conveying the roll paper P in the direction of arrow A. Such a printing apparatus 10 is used, for example, as a printer offering high-speed printing of a large number of business cards, post cards, labels and the like.

For printing an image on the roll paper P, at the time when a print starting position of the roll paper P conveyed in the direction of arrow A reaches under the print head 22K, black ink is selectively ejected from a plurality of the nozzles of the print head 22K on the basis of print data. Likewise, cyan, magenta and yellow inks are ejected respectively from the print heads 22C, 22M and 22Y, thus printing a color image on the roll paper P.

Figure 2:
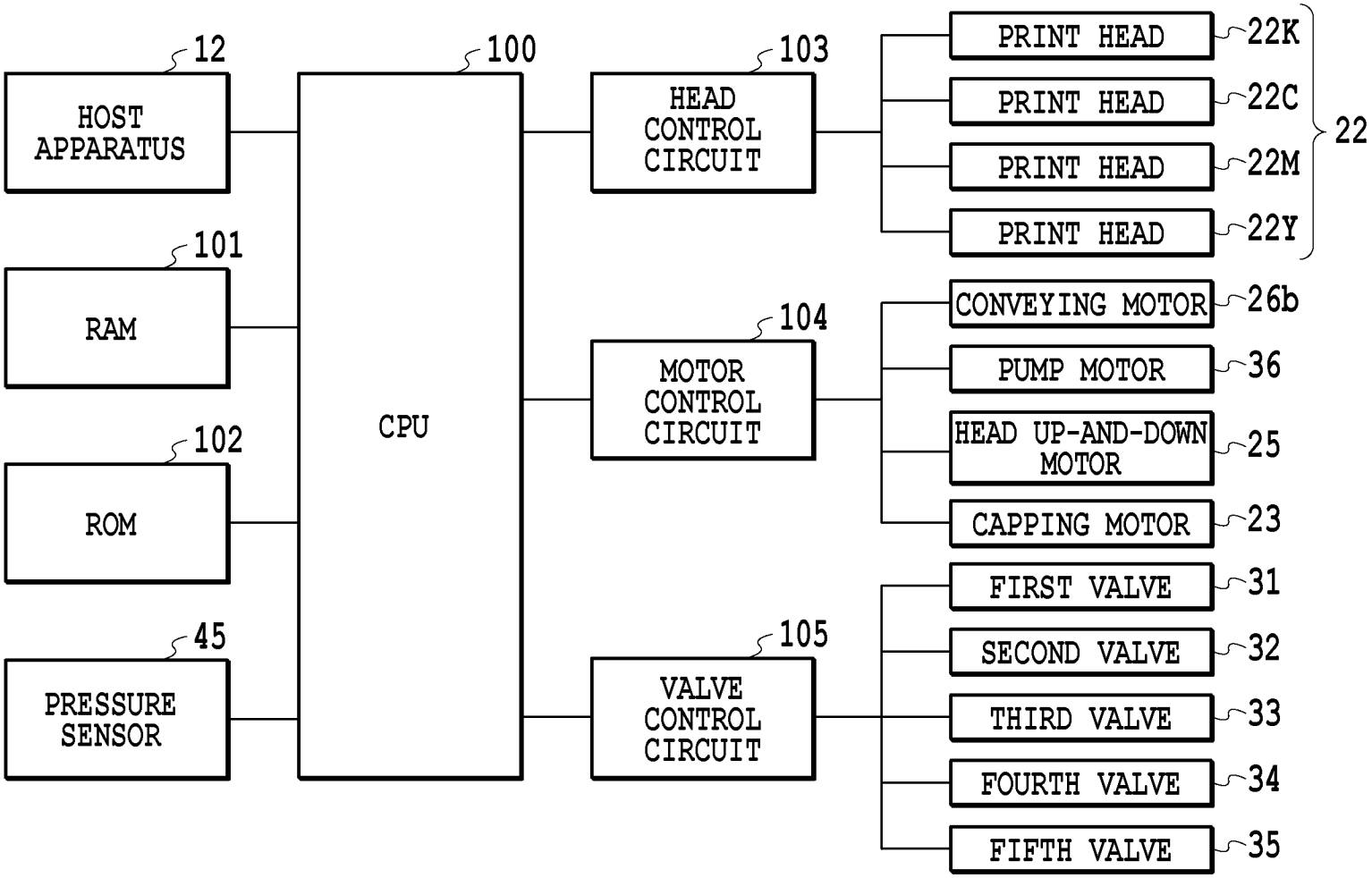
FIG. 2 is a block diagram of a control system in the printing apparatus illustrated in FIG. 1.

FIG. 2 is a schematic block diagram of a control system of the printing apparatus 10. The printing apparatus 10 has a CPU 100 receiving print data, commands and the like transmitted from the host apparatus 12. The CPU 100 is a processor controller that controls the entire operation of the printing apparatus 10, such as reception of print data, print operation, and handling of roll paper P. The CPU 100 analyzes the received commands, then develops image data for each color component in a RAM 101, and then transmits print data corresponding to each print head 22 (22K, 22C, 22M, 22Y) through a head control circuit 103. Before the print operation, the CPU 100 drives a capping motor 23 and a head up-and-down motor 25 through a motor control circuit 104 to move the print head 22 from a capping position to a printing position. The capping position is where the print head 22 is capped with the cap in the recovery unit 50. The cap is moved by the capping motor 23 and the print head 22 is moved in the vertical direction of arrow B by the head up-and-down motor 25.

The CPU 100 drives the conveying motor 26*b* through the motor control circuit 104 to convey the roll paper P in the direction of arrow A. Also, the CPU 100 transmits the print data for each color component developed in the RAM 101, from the head control circuit 103 to the corresponding print head 22 in synchronization with the conveyance of the roll paper P. As a result, the inks are ejected from the print heads 22 to print a color image on the roll paper P. Also the CPU 100 drives, according to a control program stored in the ROM 102, a pump motor 36, the head up-and-down motor 25, the capping motor 23, a first valve 31, a second valve 32, a third valve 33, a fourth valve 34 and a fifth valve 35. This enables execution of the recovery process (including the suction recovery process and the wiping process) to maintain the ink ejection performance in the print head 22. The pump motor 36, the first valve 31, the second valve 32, the third valve 33, the fourth valve 34 and the fifth valve 35 will be described later. Further, the CPU 100 executes a following pressure measurement process based on a detection signal from a pressure sensor 45 and a following process in accordance with the measurement result.

Figure 3:
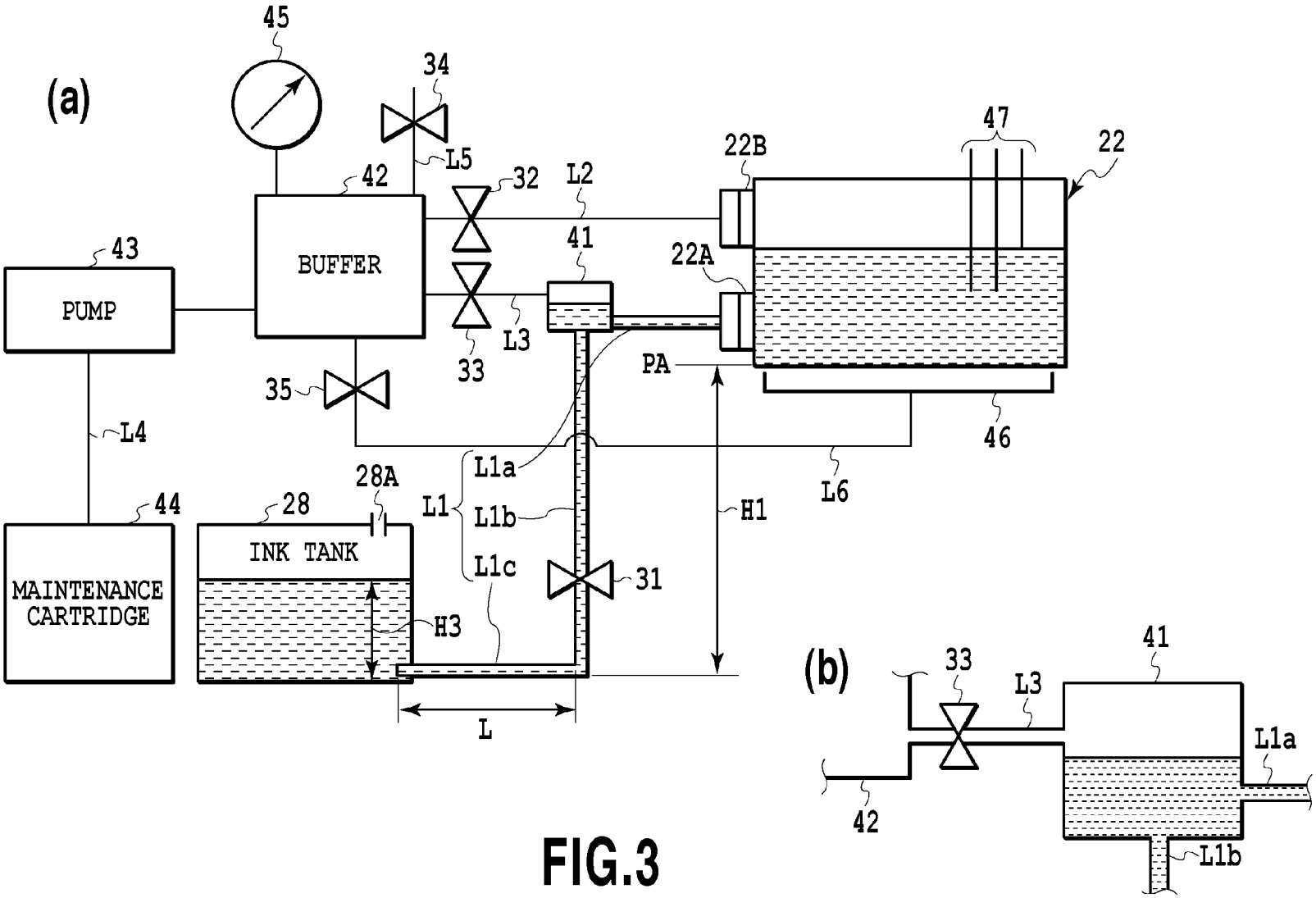
FIG. 3 is schematic block diagrams of an ink supply system and a recovery process system in the printing apparatus illustrated in FIG. 1.

The illustrative diagrams in the portions (a), (b) of FIG. 3 show the configuration of an ink supply system to one print head 22 and the configuration of a recovery process system for the print head. Likewise, the ink supply system and the recovery process system are provided for each of the other print heads 22.

An ink supply portion 22A of the print head 22 communicates by a supply passage L1 with the ink tank (liquid storage section) 28 placed at a lower level than the print head 22 is placed. In this manner, because the print head 22 communicates with the ink tank 28 with a position level difference between them, a negative pressure caused by a hydraulic head difference of ink corresponding to the position level difference is applied to the ink in the print head 22. The print head 22 includes a liquid level sensor 47 using a plurality of electrodes to detect whether or not the liquid level of the ink in the print head 22 falls within a predetermined range. A communication port 28A communicating with atmosphere is formed in an upper portion of the ink tank 28.

The supply passage L1 includes horizontally extending portions L1*a*, L1*c* and a vertically extending portion L1*b*. A first openable-and-closable valve 31 (see FIG. 2) is provided in the portion L1*b*. A gas liquid separation chamber 41, as illustrated in the portion (b) of FIG. 3, is provided between the portion L1*a* and the portion L1*b*. A pressure introduction portion 22B of the print head 22 communicates with a pressure storage chamber as a gas chamber (hereinafter referred to as a "buffer") 42 by a pressure introduction passage L2. A second valve 32 (see FIG. 2) is placed in the pressure introduction passage L2. The buffer 42 is designed to create a gas chamber available as a closed space trapping air (gas), and communicates with the gas liquid separation chamber 41 by a communication passage L3. A third openable-and-closable valve 33 (see FIG. 2) is provided in the communication passage L3. The buffer 42 is capable of storing the pressure to be introduced into the print head 22 as described later.

The buffer 42 communicates by a communication passage L4 with a maintenance cartridge 44 for collecting waste ink. A pump 43 is placed in the communication passage L4 and is able to be rotated in both forward and reverse directions by the pump motor 36 (see FIG. 2). The pump 43 employed in the present embodiment is a tube pump used to suction or apply pressure from or to the inside of the buffer 42 in response to the rotation direction and blocks the communication passage L4 when the rotation is stopped. The inside of the buffer 42 communicates with atmosphere by a communication passage L5. A fourth openable-and-closable valve 34 (see FIG. 2) is placed in the communication passage L5. The buffer 42 includes a pressure sensor 45 for detecting a pressure of gas in the buffer 42. In addition, the buffer 42 communicates with a cap 46 by a suction passage L6. A fifth openable-and-closable valve 35 is placed in the suction passage L6. The cap 46 is placed in the recovery unit 50 and is moved by the capping motor 23 (see FIG. 2) as described earlier.

(Print Operation)

In the print operation, the CPU 100 closes the second valve 32, the third valve 33, the fourth valve 34 and the fifth valve 35, and opens the first valve 31. This causes the pressure (negative pressure) corresponding to the position level difference between the locations of the print head 22 and the ink tank 28 to be applied to the ink in the print head 22 so that a meniscus of ink is formed at the ejection port of the nozzle in the print head 22. This inhibits the leakage of ink from the ejection port of the nozzle. In this manner, while a predetermined pressure (negative pressure) is applied to the ink in the print head 22, the CPU 100 causes the printing apparatus to eject the ink from the nozzles of the print head 22 on the basis of the print data while conveying the roll paper P in the direction of arrow A to print an image on the roll paper P.

The dissolved air in the ink, the air that has entered the supply passage L1, and the like are separated to collect in an upper portion of the gas liquid separation chamber 41 as illustrated in the portion (b) of FIG. 3. The separated air is not supplied to the print head 22, and the separated ink collected in a lower portion is supplied to the print head 22 through the portion L1*a* of the supply passage L1. This inhibits the entry of air into the print head 22 from the supply passage L1, thus minimizing the occurrence of ink ejection failures of the print head 22 caused by the air entry. During the non-print operation, the CPU 100 opens the third valve 33 and rotates the pump 43 in one direction, allowing the air accumulated in the gas liquid separation chamber 41 to be removed into the maintenance cartridge 44 through the communication passage L3, the buffer 42 and the communication passage L4.

(Preliminary Ejection)

The CPU 100 ejects ink that does not contribute to image printing from the print head 22 toward the inside of the cap 46 during the non-print operation (preliminary ejection), thus making it possible to maintain the ink ejection performance in the print head 22.

(Suction Recovery Process)

The CPU 100 is able to execute the suction recovery process during the non-print operation. In the suction recovery process, the CPU 100 caps the print head 22 with the cap 46. Then, the CPU 100 closes the second valve 32, the third valve 33, the fourth valve 34 and the fifth valve 35, and operates the first valve 31 to an open position. Then, the CPU 100 rotates the pump 43 in one direction. As a result, the buffer 42 is suctioned until the pressure in the buffer 42 reaches a predetermined pressure (negative pressure). After detecting that the pressure in the buffer 42 has reached the predetermined pressure based on a detection signal from the pressure sensor 45, the CPU 100 stops the pump 43 and then opens the fifth valve 35. As a result, the ink in the print head 22 is sucked from the ejection port of the nozzle distal end to be discharged into the cap 46. The sucked and discharged ink is collected into the buffer 42 through the suction passage L6. Then, the CPU 100 moves the cap 46 away from the print head 22 to bring about a non-capping state, and then rotates the pump 43 in one direction. As a result, the ink in the cap 46, the suction passage L6 and the buffer 42 is collected into the maintenance cartridge 44 through the communication passage L4.

(Pressurization Recovery Process)

The CPU 100 is able to execute the pressurization recovery process during the non-print operation. In the pressurization recovery process, the CPU 100 closes the first valve 31 to the fifth valve 35. Then, the CPU 100 rotates the pump 43 in the opposite direction to apply pressure to the inside of the buffer 42 so that the pressure in the buffer 42 reaches a predetermined positive pressure. After detecting that the pressure in the buffer 42 has reached the predetermined positive pressure based on the detection signal from the pressure sensor 45, the CPU 100 stops the pump 43 and then opens the second valve 32. This applies the pressure to the inside of the print head 22 so as to force the ink in the print head 22 to be pushed from the ejection port of the nozzle distal end into the cap 46. The cap 46 accepts the pushed-out ink. Then, the CPU 100 closes the second valve 32 and opens the fifth valve 35, and then rotates the pump 43 in one direction. As a result, the ink in the cap 46 is collected into the maintenance cartridge 44 through the suction passage L6, the buffer 42 and the communication passage L4.

(Wiping Process)

During the non-print operation, the CPU 100 is able to execute a wiping process after the preliminary ejection, after the suction recovery process and after the pressurization recovery process. In the wiping process, the CPU 100 operates the wiper member provided in the recovery unit 50 to wipe the formation surface of the ejection port in the print head 22, for removal of ink having adhered to the formation surface. Combined with the preliminary ejection, the suction recovery process and the pressurization recovery process, this makes it possible to maintain the ink ejection performance in the print head 22.

(Detection Process of Remaining Ink Level)

Figure 4:
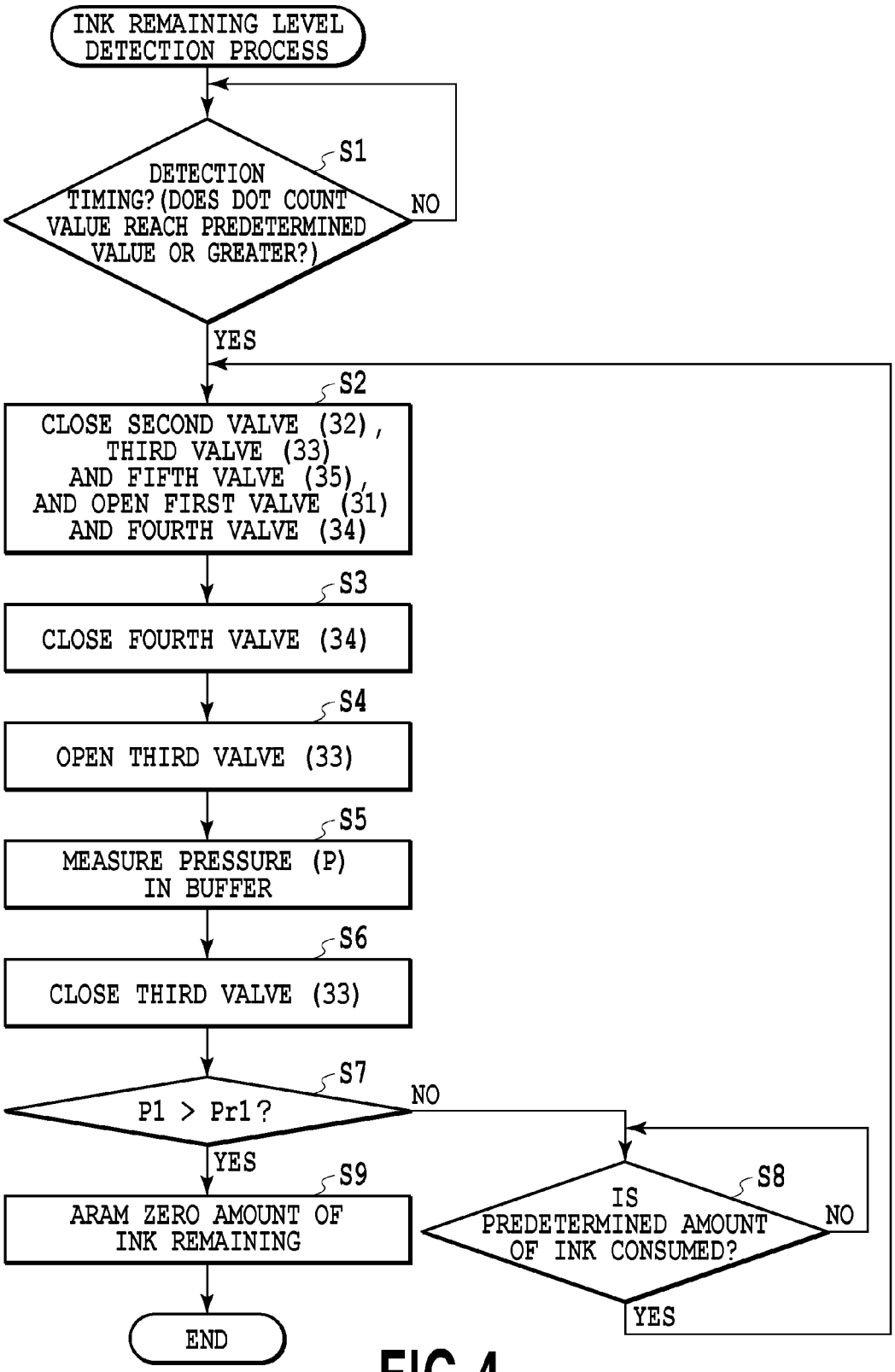
FIG. 4 is a flowchart illustrating the process of detecting the amount of ink remaining according to the first embodiment of the present invention.

FIG. 4 is a flowchart illustrating the detection process for detecting the amount of ink remaining in the ink tank 28. The CPU 100 is able to perform the detection process during the non-print operation.

Figure 5A:
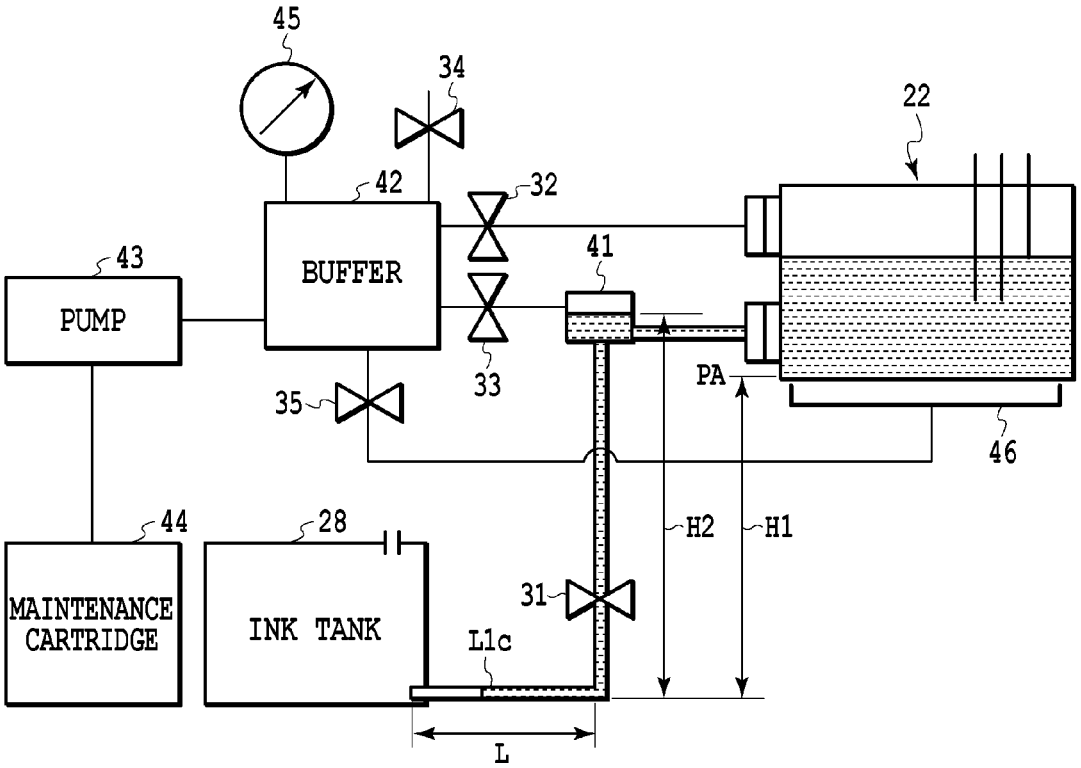
FIGS. 5A and 5B are block diagrams each illustrating the ink supply system in FIG. 3 when the remaining amount of ink is varied.

Initially, the CPU 100 determines whether or not the timing is right to detect the amount of ink remaining in the ink tank 28 (step S1). In the present embodiment, this can be determined by determining whether or not a dot count value reaches a predetermined value. The dot count value refers to a value of the cumulative total number of ink droplets ejected from the nozzles into which the amount of ink ejected from the print head 22 and the amount of ink preliminarily ejected or discharged from the nozzles for the print head recovery process are converted, which corresponds to the consumption amount of ink. The consumption amount of ink corresponding to the dot count value may have an error resulting from variations in the amount of ejection per droplet of ink and the like. In the present embodiment, the right timing for detecting the amount of ink remaining is determined as the time when the dot count value is equal to or greater than a predetermined value corresponding to the amount of ink stored in the ink tank 28, and with this detection timing the amount of ink remaining in the ink tank 28 is detected more accurately. Specifically, the detection timing for detecting the amount of ink remaining is determined as the time when the ink is consumed to the extent that the bottom end of the ink flowing in the supply passage L1 reaches the portion L1*c*, as illustrated in FIG. 5A. When the bottom end of the ink flowing in the supply passage L1 is positioned in the portion L1*c*, a negative pressure is applied to the ink in the print head 22 because of a hydraulic head difference corresponding to a height H1 between the position of the bottom end of the ink and the formation surface of the ejection port in the print head 22.

When the dot count value is equal to or greater than the predetermined value, the CPU 100 operates the second valve 32, the third valve 33 and the fifth valve 35 to a closed position, and operates the first valve 31 and the fourth valve 34 to an open position (step S2). This causes the pressure in the buffer 42 to reach atmospheric pressure. After the pressure in the buffer 42 has been adjusted to atmospheric pressure in this manner, the CPU 100 closes the fourth valve 34 (step S3) to hold the pressure in the buffer 42 at atmospheric pressure, and then opens the third valve 33 (step S4). This causes the buffer 42 and the gas liquid separation chamber 41 to communicate by the communication passage L3 with each other. At this point, the buffer 42 is in a state of being unaffected by pressure applied from components other than the communication passage L3, because the second valve 32, the fourth valve 34 and the fifth valve 35 are closed and the pump 43 is stopped to block the communication passage L4. In short, the buffer 42 is fully enclosed except for the part communicating with the communication passage L3.

Figure 5B:
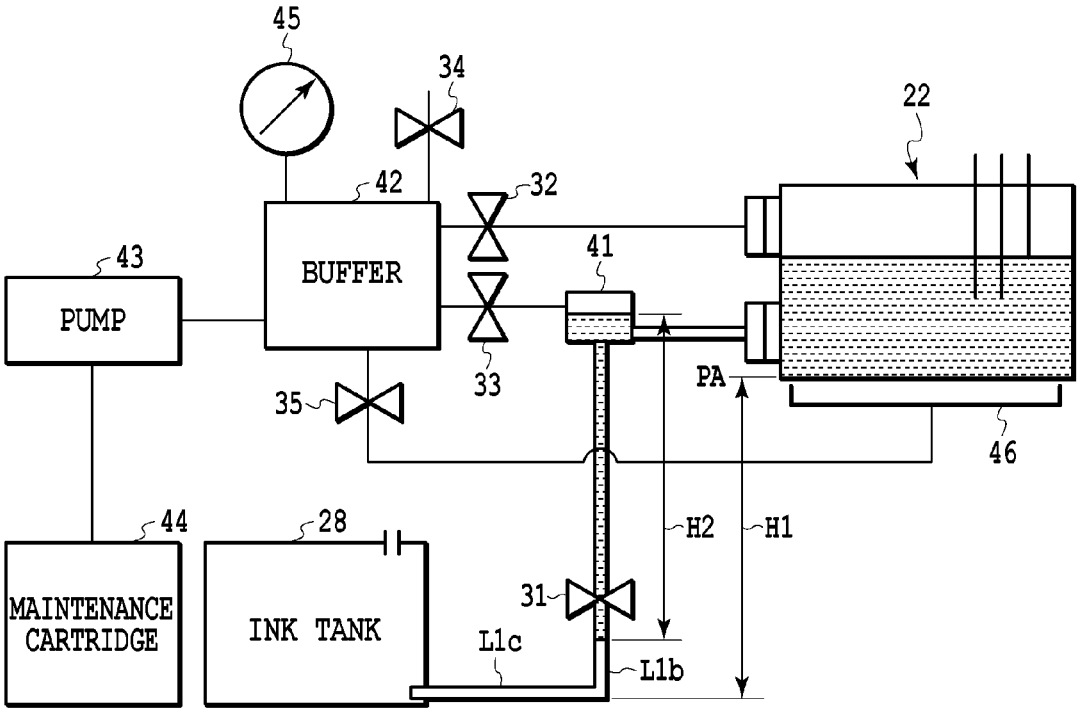

The gas liquid separation chamber 41 is subjected to pressure (negative pressure) developed by the hydraulic head difference corresponding to a height H2 between the liquid level in the gas liquid separation chamber 41 and the position of the bottom end of the ink in the supply passage L1. The height H2 when the bottom end of the ink is positioned in the portion L1*c* as illustrated in FIG. 5A is greater than the height H2 when the bottom end of the ink is positioned in the portion L1*b* as illustrated in FIG. 5B. Because of this, the pressure acting on the inside of the gas liquid separation chamber 41 illustrated in FIG. 5A is lower than the pressure acting on the inside of the gas liquid separation chamber 41 illustrated in FIG. 5B. In other words, the negative pressure acting on the inside of the gas liquid separation chamber 41 in FIG. 5A is greater than the negative pressure acting on the inside of the gas liquid separation chamber 41 in FIG. 5B. That is, as the bottom end of the ink in the supply passage L1 moves more upward, or as the height H2 becomes shorter with an increasing consumption of ink by the print head 22, the pressure in the gas liquid separation chamber 41 increases (negative pressure reduces).

Such communication via the communication passage L3 between the gas liquid separation chamber 41 to which the negative pressure corresponding to the height H2 is applied and the buffer 42 in which the pressure is held at atmospheric pressure causes the pressure in the buffer 42 to fall below atmospheric pressure. The smaller the height H2, or the lower the negative pressure in the gas liquid separation chamber 41, the smaller the pressure drop in the buffer 42 becomes. The CPU 100 operates the pressure sensor 45 to measure pressure P1 varying in the buffer 42 as described above (step S5), and then closes the third valve 33 (step S6). Then, the CPU 100 determines whether or not the measured pressure P1 exceeds a predetermined reference pressure Pr1 (step S7). When the measured pressure P1 is equal to or lower than the reference pressure Pr1, the CPU 100 determines whether or not a predetermined amount of ink has been consumed (step S8) after step S7. When the predetermined amount of ink has been consumed, the process goes back to step S2. In the present embodiment, after waiting until the dot count number subsequently reaches a predetermined value, the process goes back to step S2. When the measured pressure P1 exceeds the reference pressure Pr1, the CPU 100 determines that the amount of ink remaining in the ink tank 28 has become zero, and raises an alarm indicating that the amount of ink remaining is zero by means of sound, a message displayed on a screen, and/or the like (step S9).

When the position of the bottom end of the ink in the supply passage L1 rises to a position PA of the formation surface of the ejection port of the print head 22, the hydraulic head difference acting on the ink in the ejection port of the print head 22 is 0 mmAq, so that the negative pressure is not applied to the ink in the print head 22. Therefore, it is necessary to determine that the amount of ink remaining in the ink tank 28 is decreased to zero before the position of the bottom end of the ink in the supply passage L1 rises to the position PA. For that purpose, the reference pressure Pr1 is set at a value measured in step S5, which is detected when the bottom end of the ink in the supply passage L1 is located at a predetermined distance from the position PA in a downward direction.

Thus setting the reference pressure Pr1 enables the CPU 100 to determine that the amount of ink remaining in the ink tank 28 is decreased to zero based on the measured pressure P in the buffer 42 before there occurs a state where the negative pressure is not applied to the ink in the print head 22, thereby providing an alarm.

Second Embodiment

Figure 6:
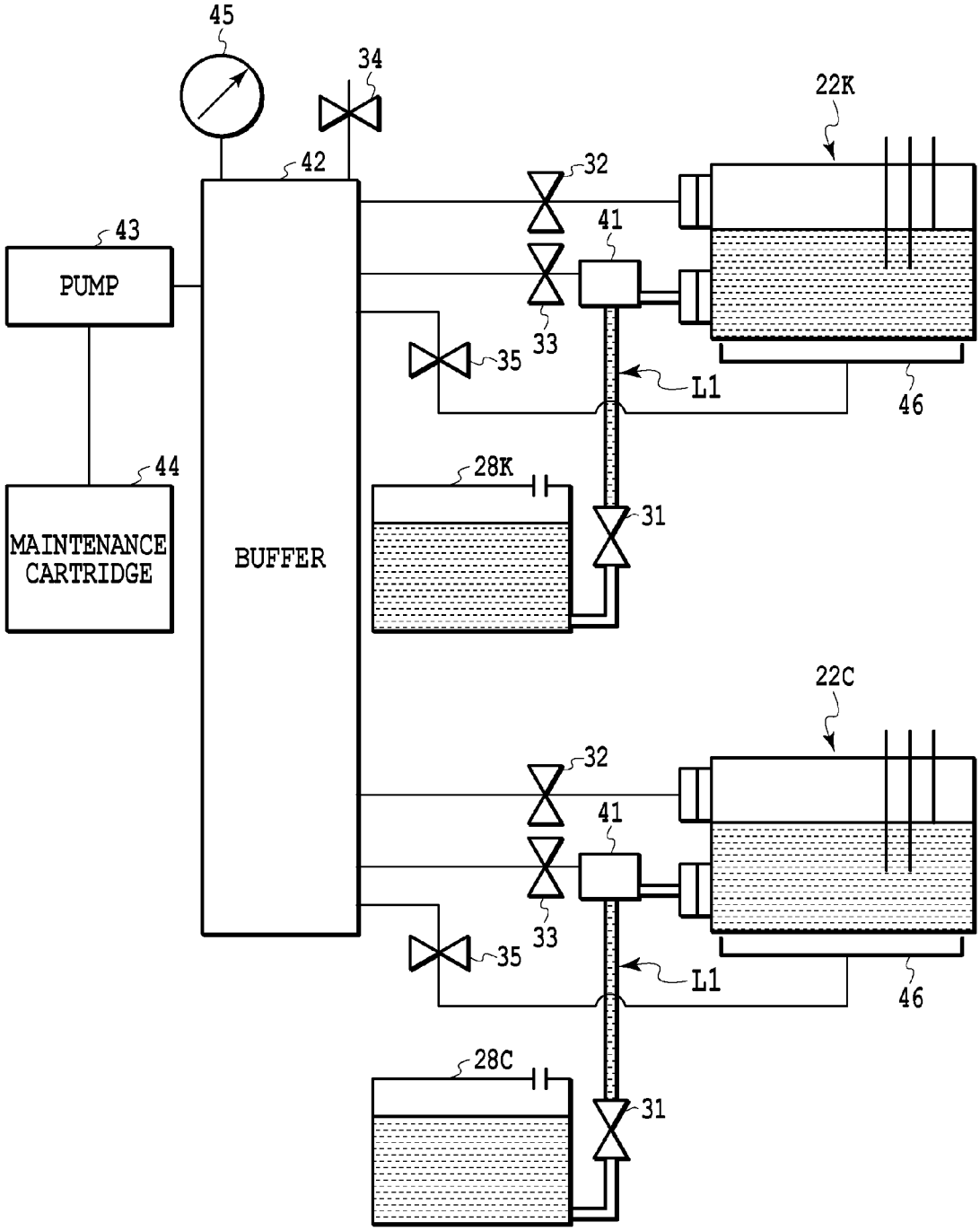
FIG. 6 is a schematic block diagram of an ink supply system and a recovery process system according to a second embodiment of the present invention.

In the first embodiment the ink supply system and the recovery process system for the print head 22 as a unit are connected to the single buffer 42. In the second embodiment, as illustrated in FIG. 6, a plurality of sets of ink supply systems and recovery process systems for the respective print heads 22 are connected to a single buffer 42. In the present embodiment, the two sets of the ink supply systems and the recovery process systems for the two print heads 22*k*, 22C are connected to the single buffer 42. The configuration of the other components is the same as that in the first embodiment, and the description is omitted. In the ink supply apparatus having such a structure, a plurality of supply passages L1 are provided for the respective print heads 22, so that a plurality of regions where the ink pressure varies according to the amount of ink remaining are specified by the gas liquid separation chambers 41 provided in the respective supply passages L1. In this manner, the single buffer is shared among a plurality of the ink supply systems, and thereby can detect the amount of ink remaining in a plurality of ink tanks.

Third Embodiment

In the aforementioned first embodiment, for a measurement of the pressure in the buffer 42, the third valve 33 is opened (step S4) to establish communication between the buffer 42 held at atmospheric pressure and the gas liquid separation chamber 41. At this point, the atmospheric pressure in the buffer 42 may possibly cause the air in the buffer 42 to flow from the communication passage L3 into the gas liquid separation chamber 41. In the third embodiment, for the purpose of inhibiting such entry of air into the gas liquid separation chamber 41, the inside of the buffer 42 is held at a predetermined pressure in advance before the pressure in the buffer 42 is measured.

Figure 7:
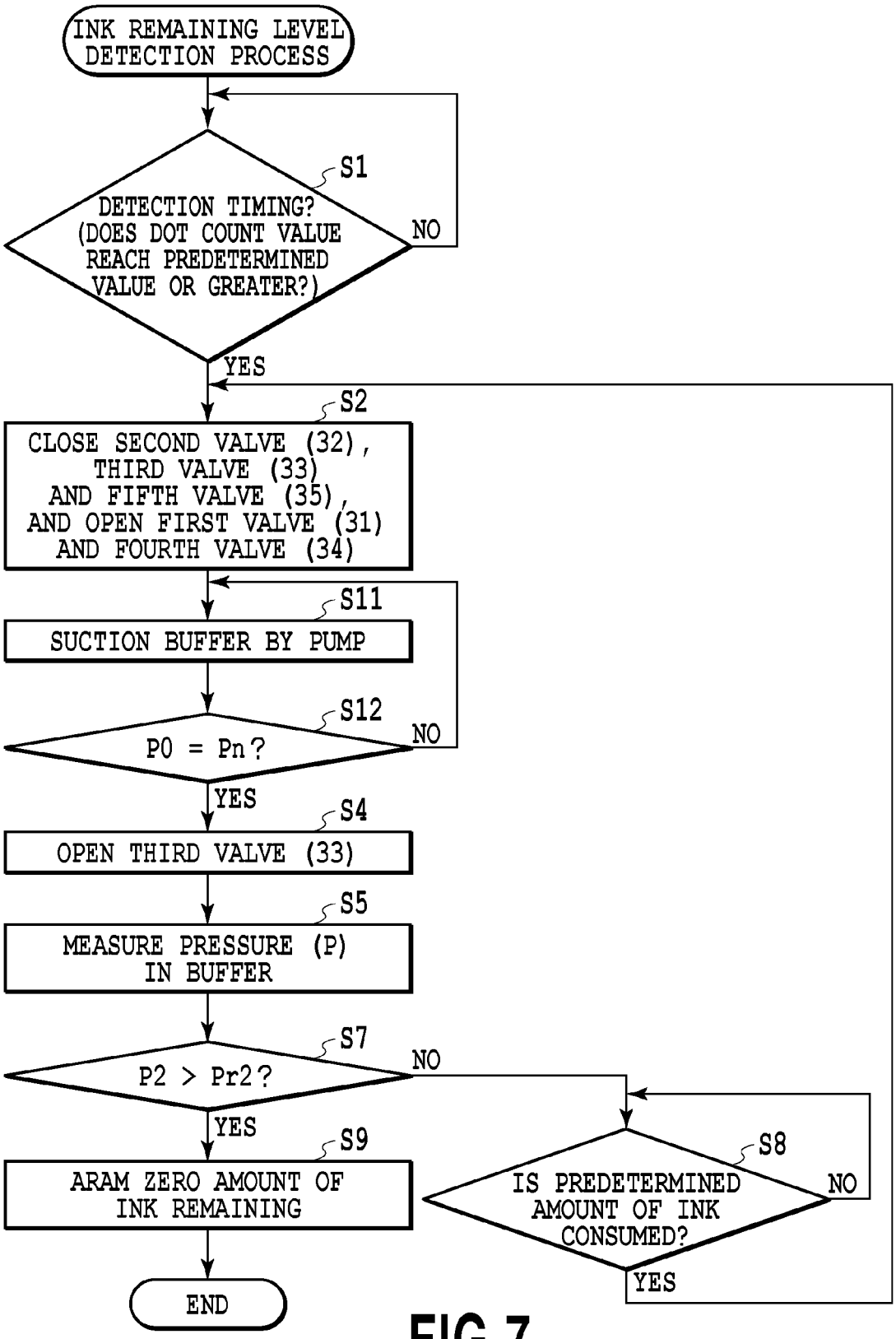
FIG. 7 is a flowchart illustrating the process of detecting the amount of ink remaining according to a third embodiment of the present invention.

FIG. 7 is a flowchart illustrating the process of detecting the amount of ink remaining in the present embodiment, in which the identical steps as those in FIG. 4 described in the aforementioned embodiment are designated by the same reference signs and will not be described. In the present embodiment, before step S4 in which the third valve 33 is opened, the CPU 100 controls pressure P0 in the buffer 42 to a predetermined pressure Pn. For that purpose, while monitoring the pressure in the buffer 42 by use of the pressure sensor 45, the CPU 100 rotates the pump 43 in one direction until the pressure P0 reaches the predetermined pressure Pn to suction the buffer 42 to bring about a negative-pressure state (steps S11, S12). Then, the third valve 33 is opened (step S4), and then the pressure in the buffer 42 is measured (step S5). The pressure Pn is set to be lower than the pressure in the gas liquid separation chamber 41 under the condition as illustrated in FIG. 5A, that is, to be lower than the pressure caused by a hydraulic head difference corresponding to the height H2 formed when the bottom end of the ink in the supply passage L1 is positioned in the portion L1*c*. As a result, when the third valve 33 is opened to measure the pressure in the buffer 42, there is no possibility that the air in the buffer 42 will enter the gas liquid separation chamber 41 from the communication passage L3.

In a case where ink enters the buffer 42, the ink in the buffer 42 is capable of being discharged into the maintenance cartridge 44 by rotating the pump 43 in one direction after the second, third and fifth valves 32, 33, 35 are closed and the fourth valve 34 is opened.

The third embodiment may be performed in the second embodiment.

Fourth Embodiment

In the fourth embodiment, as in the embodiment described earlier, every time the dot count number reaches the predetermined value, the CPU 100 repeatedly measures the pressure in the buffer 42 for detection of the amount of ink remaining and detects the amount of ink remaining based on a progression of the measurement result. Since the present embodiment has the similar configuration with the exception that the process in step S7 in the flow (FIG. 4) described in the first embodiment is different, the similar configuration will not described.

Figure 8:
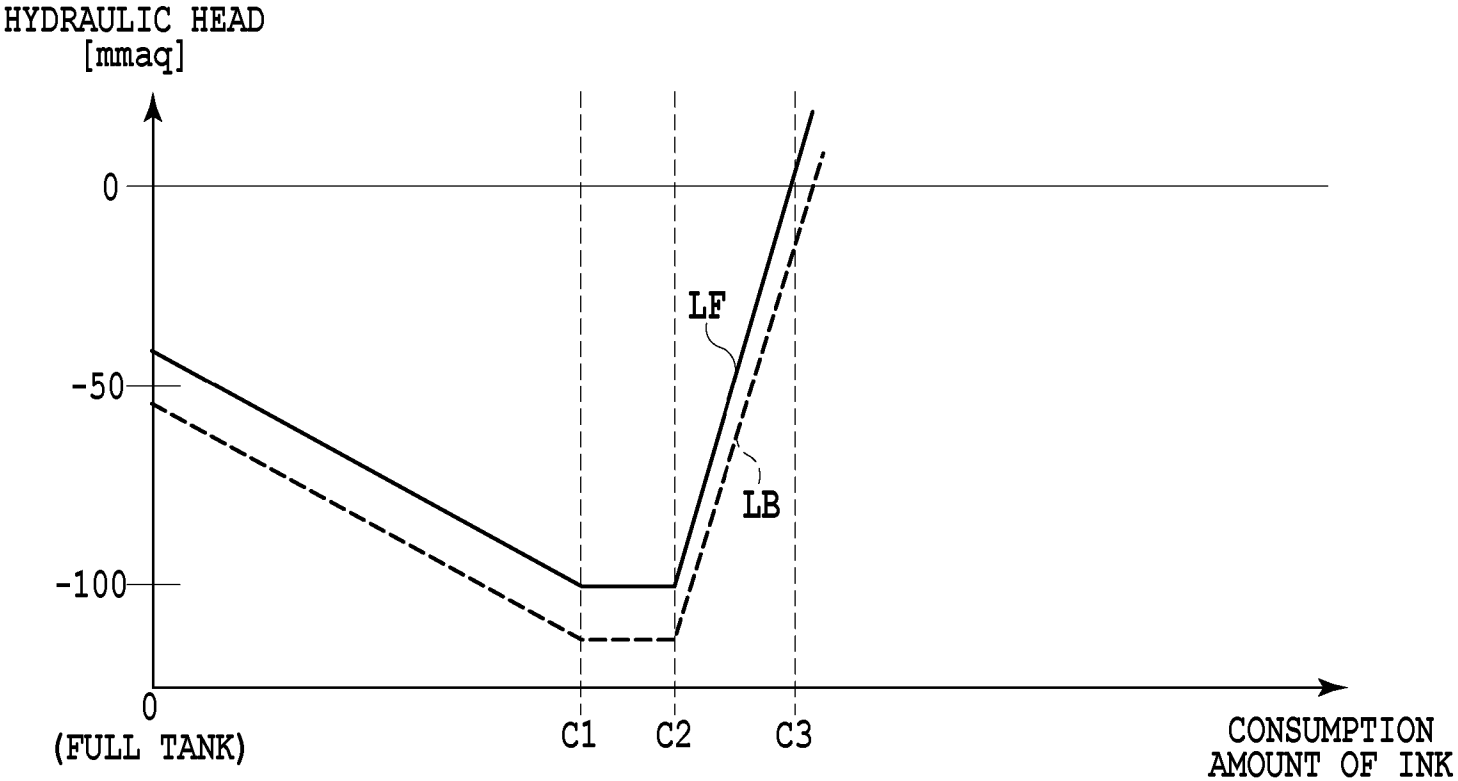
FIG. 8 is a chart showing the progression of measurement of pressure in a buffer according to a fourth embodiment of the present invention.

FIG. 8 is a chart illustrating the relationship between the measurement result obtained when the pressure in the buffer 42 is repeatedly measured as in the first embodiment described earlier and the consumption amount of ink in the ink tank 28. When the consumption amount of ink is "zero", the ink tank 28 is in a full-tank condition in which the ink tank 28 is filled with ink as illustrated in the portion (a) of FIG. 3, in which the liquid level height is H3. When the consumption amount of ink is C1, it is the time when the amount of ink corresponding to the height H3 is consumed and the bottom end of the ink in the supply passage L1 starts to enter the portion L1*c*. When the consumption amount of ink is C2, it is the time when the amount of ink corresponding to the length L (FIG. 5A) of the portion L1*c* of the supply passage L1 is further consumed and the bottom end of the ink in the supply passage L1 starts to enter the portion L1*b*. When the consumption amount of ink is C3, it is the time when the amount of ink corresponding to the height H1 (FIG. 5B) of the portion L1*b* of the supply passage L1 is further consumed and the bottom end of the ink in the supply passage L1 reaches the height position PA (FIG. 5B).

In FIG. 8, the dotted line LB shows a change in measured pressure in the buffer 42 during the process of detecting the amount of ink remaining. The solid line LF shows a change in pressure applied to the ink surface in the ejection port of the print head 22 when the second valve 32, the third valve 33, the fourth valve 34 and the fifth valve 35 are closed and the first valve 31 is opened. The lines LB, LF decline as the liquid level of the ink in the ink tank 28 lowers, until the consumption amount of ink increases from "zero" to C1. Then, between the consumption amounts of ink C1 and C2, the lines LB, LF are horizontal because the height position of the bottom end of the ink in the supply passage L1 does not change. Then, between the consumption amounts of ink C2 and C3, the lines LB, LF rise as the position of the bottom end of the ink in the supply passage L1 rises. In this manner, the pressures on the lines LB, LF vary according to the moving position of the bottom end of the ink in the supply passage L1. In the consumption amount of ink C3, the line LF rises to "zero", that is, the negative pressure applied to the ink surface in the ejection port of the print head 22 becomes "zero".

Before the consumption amount of ink reaches C3, it is necessary to detect and make notification that the amount of ink remaining in the ink tank 28 is zero. It is desirable to detect and make notification that the amount of ink remaining in the ink tank 28 is zero when the consumption amount of ink is C2 or greater and less than C3. In the present embodiment, the CPU 100 detects a point when the measured pressure in the buffer 42 turns upward as shown by line LB, that is, a point when the consumption amount of ink exceeds C2. At this time, the CPU 100 makes notification that the amount of ink remaining in the ink tank 28 is decreased to be zero. In other words, in the present embodiment, the process in step S7 in FIG. 4 in the first embodiment is replaced with the process of the CPU 100 determining whether or not the measured pressure in the buffer 42 turns upward. When the CPU 100 determines in the replaced step S7 that the measured pressure in the buffer 42 has turned upward, the CPU 100 determines that the amount of ink remaining in the ink tank 28 has become zero. When the CPU 100 determines in the replaced step S7 that the measured pressure in the buffer 42 does not turn upward, the process goes to step S8.

In the present embodiment, the process in step S7 in FIG. 7 in the third embodiment may be replaced with the process of the CPU 100 determining whether or not the measured pressure in the buffer 42 turns upward. The apparatus configuration in the second embodiment may be employed as apparatus configuration for carrying out the present embodiment.

Fifth Embodiment

In the aforementioned four embodiments, the gas liquid separation chamber 41 provided in the supply passage L1 is set as a region where the ink pressure varies according to the amount of ink remaining in the ink tank 28 or in the supply passage L1. The pressure sensor 45 is used to detect a pressure of air in the buffer 42 corresponding to the pressure in the gas liquid separation chamber 41.

However, the region where the ink pressure varies according to the amount of ink remaining may be provided in a halfway position in the supply passage L1 or in the ink tank 28 in the aforementioned four embodiments. For example, the region where the ink pressure varies according to the amount of ink remaining may be provided in the ink tank 28, and the ink tank 28 may be fully enclosed except for a supply portion for ink supply to the print head 22. In this case, the ink pressure in the region drops as the liquid level of the ink in the ink tank 28 lowers, that is, as the amount of ink remaining in the ink tank 28 is decreased. In another configuration, the region where the ink pressure varies according to the amount of ink remaining may be set in the ink tank 28 and the ink tank may be left open for atmosphere. In this case, a communication passage may be connected to a portion located below the liquid level of the ink stored in the ink tank 28, and further the communication passage may be provided with a gas accommodating region for accommodating gas. Then, the communication passage may be under conditions of being unaffected by pressure applied from portions other than the connection portion to the ink tank 28, so that the CPU 100 may detect gas pressure in the gas accommodating region. As a result, the ink pressure in this region drops as the liquid level of the ink in the ink tank 28 lowers, that is, as the amount of ink remaining in the ink tank 28 is decreased.

In another way, the region where the ink pressure varies according to the amount of ink remaining may be provided in the print head 22.

Other Embodiment

The present invention is applicable widely to a liquid supply apparatus for supplying various types of liquid and a liquid ejection apparatus capable of ejecting various types of liquid in the aforementioned five embodiments. Also, the present invention is applicable to a liquid ejecting apparatus that uses a liquid ejection head capable of ejecting liquid to perform various processes (printing, processing, coating, irradiation, reading, inspection, and the like) on various media (sheet). The media (including a print medium) include various types of media to which a liquid including ink is applied, without distinction of materials, such as paper, plastic, film, textile fabrics, metal, flexible substrates, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-064372, filed Mar. 26, 2014, which is hereby incorporated by reference wherein in its entirety.

What is claimed is:

1. A liquid supply apparatus including a supply passage for supplying a liquid stored in a liquid storage section to a liquid ejection head, comprising:

a gas liquid separation chamber configured to separate a gas contained in the liquid, wherein pressure applied to the gas varies according to an amount of the liquid remaining in the liquid storage section or in the supply passage;

a pressure detecting unit configured to detect the pressure of the gas in the gas liquid separation chamber; and a determination unit configured to determine the amount of the liquid in the liquid storage section based on a detection result by the pressure detecting unit.

2. The liquid supply apparatus according to claim 1, wherein:

the supply passage is structured to apply negative pressure to the liquid to be supplied to the liquid ejection head;

the gas liquid separation chamber is set inside the supply passage; and the pressure applied to the gas in the gas liquid separation chamber is negative pressure.

3. The liquid supply apparatus according to claim 1, further comprising:

a gas chamber;

an opening and closing unit configured to open and to close a communication passage between the gas liquid separation chamber and the gas chamber; and a pressure regulation unit configured to regulate the pressure in the gas chamber.

4. The liquid supply apparatus according to claim 3, further comprising:

a control unit configured to use the pressure regulation unit to adjust the pressure in the gas chamber to a predetermined pressure and then operate the opening and closing unit to open the communication passage.

5. The liquid supply apparatus according to claim 4, wherein:

the supply passage includes a horizontally extending portion and a vertically extending portion; and the negative pressure of the gas in the gas liquid separation chamber varies according to a moving position of a bottom end of the liquid in the supply passage.

6. The liquid supply apparatus according to claim 5, wherein the determination unit determines that the liquid storage section does not store ink when the negative pressure of the gas in the gas liquid separation chamber produces a predetermined change.

7. The liquid supply apparatus according to claim 6, wherein:

the gas chamber is a buffer capable of storing pressure to be introduced into the liquid ejection head.

8. The liquid supply apparatus according to claim 7, wherein:

the supply passage includes a plurality of supply passages that are provided to correspond to a plurality of sets of the liquid storage sections and the liquid ejection heads;

the gas liquid separation chamber includes a plurality of gas liquid separation chambers that are set to correspond to a plurality of sets of the liquid storage sections, the liquid ejection heads and the supply passages; and the gas chamber communicates selectively with each of the plurality of gas liquid separation chambers.

9. The liquid supply apparatus according to claim 1, wherein:

the gas liquid separation chamber is set inside the supply passage; and the pressure applied to the gas in the gas liquid separation chamber decreases as a liquid level in the liquid storage section lowers.

10. The liquid supply apparatus according to claim 1, wherein the pressure detecting unit has a gas chamber communicating with the gas liquid separation chamber in such a manner that a pressure of gas in the gas chamber varies according to the pressure of the gas in the gas liquid separation chamber; and wherein the determination unit determines the amount of the liquid in the liquid storage section based on pressure in the gas chamber.

11. A liquid ejection apparatus comprising a liquid ejection head and a liquid supply apparatus including a supply passage for supplying liquid to the liquid ejection head, wherein the liquid supply apparatus comprises:

a liquid storage section;

a gas liquid separation chamber configured to separate a gas contained in the liquid, wherein pressure applied to the gas varies according to an amount of the liquid remaining in the liquid storage section or in the supply passage;

a pressure detecting unit configured to detect the pressure of the gas in the gas liquid separation chamber; and a determination unit configured to determine the amount of the liquid in the liquid storage section based on a detection result by the pressure detecting unit.

12. The liquid ejection apparatus according to claim 11, further comprising:

a gas chamber communicating with the gas liquid separation chamber in such a manner that a pressure of gas in the gas chamber varies according to the pressure of the gas in the gas liquid separation chamber; and wherein the pressure detecting unit detects a pressure in the gas chamber.

13. An inkjet printing apparatus comprising an inkjet print head and an ink supply apparatus including a supply passage for supplying ink to the inkjet print head, wherein the ink supply apparatus comprises:

an ink reservoir section;

a gas liquid separation chamber configured to separate a gas contained in the liquid, wherein pressure applied to the gas varies according to an amount of the ink remaining in the ink reservoir section or in the supply passage;

a pressure detecting unit configured to detect the pressure of the gas in the gas liquid separation chamber; and a determination unit configured to determine the amount of the ink in the ink reservoir section based on a detection result by the pressure detecting unit.

14. The inkjet printing apparatus according to claim 13, further comprising:

a gas chamber communicating with the gas liquid separation chamber in such a manner that a pressure of gas in the gas chamber varies according to the pressure of the gas in the gas liquid separation chamber; and wherein the pressure detecting unit detects a pressure in the gas chamber.

15. A liquid supply apparatus including a supply passage for supplying a liquid stored in a liquid storage section to a liquid ejection head, comprising:

a gas liquid separation chamber configured to separate a gas contained in the liquid, wherein a pressure applied to the gas corresponds to a hydraulic head difference between the liquid surface in the liquid storage section and liquid surface in the gas liquid separation chamber;

a pressure detecting unit configured to detect the pressure of the gas in the gas liquid separation chamber; and a determination unit configured to determine the amount of the liquid in the liquid storage section based on a detection result by the pressure detecting unit.

* * * * *